US010083663B2

(12) United States Patent
Guo et al.

(10) Patent No.: US 10,083,663 B2
(45) Date of Patent: Sep. 25, 2018

(54) GAMMA VOLTAGE GENERATION CIRCUIT AND DRIVE APPARATUS

(71) Applicant: Wuhan China Star Optoelectronics Technology Co., Ltd., Wuhan, Hubei (CN)

(72) Inventors: Xingling Guo, Guangdong (CN); Wei Chen, Guangdong (CN); Xiaoping Tan, Guangdong (CN)

(73) Assignee: Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 202 days.

(21) Appl. No.: 15/126,501

(22) PCT Filed: Aug. 10, 2016

(86) PCT No.: PCT/CN2016/094462
§ 371 (c)(1),
(2) Date: Sep. 15, 2016

(87) PCT Pub. No.: WO2018/014380
PCT Pub. Date: Jan. 25, 2018

(65) Prior Publication Data

US 2018/0197492 A1 Jul. 12, 2018

(30) Foreign Application Priority Data

Jul. 20, 2016 (CN) ..... 2016 1 0579353

(51) Int. Cl.
*G09G 3/36* (2006.01)

(52) U.S. Cl.
CPC ..... *G09G 3/3607* (2013.01); *G09G 3/3696* (2013.01); *G09G 2300/0452* (2013.01); *G09G 2320/0276* (2013.01)

(58) Field of Classification Search
CPC ..... G09G 3/3607; G09G 3/3696; G09G 2300/0452; G09G 2320/0276
See application file for complete search history.

(56) References Cited

U.S. PATENT DOCUMENTS

2006/0108615 A1 5/2006 Ha
2013/0070007 A1* 3/2013 Park ..... G09G 3/3233 345/694

(Continued)

FOREIGN PATENT DOCUMENTS

CN 1783200 A 6/2006
CN 101707050 A 5/2010

(Continued)

*Primary Examiner* — Dmitriy Bolotin
(74) *Attorney, Agent, or Firm* — Andrew C. Cheng

(57) ABSTRACT

The present application discloses a gamma voltage generating circuit, including an image detection module, a control module and a gamma voltage module; the image detection module is for acquiring an image input signal, and detecting the image input signal, when determining the gray scale indicated by the image input signal comprising a pure color gray scale, to generate and output a first detection result signal for indicating the pure color gray scale; the control module is electrically connected to the image detection module, for receiving the first detection result signal output from the image detection module and generating and outputting a first control signal in accordance with the first detection result signal; and the gamma voltage module is electrically connected to the control module to receive the first control signal output from the control module, and generate a gamma reference voltage in accordance with the first control signal.

10 Claims, 3 Drawing Sheets

(56) References Cited

U.S. PATENT DOCUMENTS

| | | | | |
|---|---|---|---|---|
| 2015/0194101 | A1* | 7/2015 | Yaras | G09G 3/3413 345/593 |
| 2017/0103713 | A1* | 4/2017 | Guo | G09G 3/3413 |

FOREIGN PATENT DOCUMENTS

| | | | |
|---|---|---|---|
| CN | 202258265 | U | 5/2012 |
| CN | 104732938 | A | 6/2015 |
| CN | 105185331 | A | 12/2015 |
| CN | 105741812 | A | 7/2016 |

* cited by examiner

GAMMA VOLTAGE GENERATION CIRCUIT AND DRIVE APPARATUS

CROSS REFERENCE

This application claims the benefit of priority of Chinese Patent Application No. 201610579353.0 entitled "GAMMA VOLTAGE GENERATION CIRCUIT AND DRIVE APPARATUS", filed Jul. 20, 2016, the disclosure of which is incorporated herein by reference in its entirety.

FIELD OF THE INVENTION

The present application relates to a liquid crystal display technology field, and more particularly to a gamma voltage generating circuit and the driving apparatus having the gamma voltage generating circuit.

BACKGROUND OF THE INVENTION

The RGBW liquid crystal panel (the liquid crystal panel in accordance with the red, green and blue and white four-color display technology) is by additional adding a W (white) pixel unit to the original RGB liquid crystal panel except the RGB three sub-pixel units, it makes the transmittance of the liquid crystal panel is greatly increased, thereby reducing the power consumption of the backlight, achieving the energy saving effect, and also enhance the contrast of the display image. However, since the introduction of W pixel unit into the RGBW liquid crystal panel, the apertures of the R, G, B three sub-pixel units in the RGBW liquid crystal panel is 75% of the conventional RGB liquid crystal panel, when displaying pure color image, the overall brightness of the RGBW panel is lower than the RGB panel, the display image is dimer.

SUMMARY OF THE INVENTION

In view of this, the present application provides a gamma voltage generating circuit and the driving apparatus having the gamma voltage generating circuit to enhance the overall brightness performance of the RGBW liquid crystal panel.

A gamma voltage generating circuit, including an image detection module, a control module and a gamma voltage module; the image detection module is for acquiring an image input signal, and detecting the image input signal, when determining the gray scale indicated by the image input signal including a pure color gray scale, to generate and output a first detection result signal for indicating the pure color gray scale; the control module is electrically connected to the image detection module, for receiving the first detection result signal output from the image detection module and generating and outputting a first control signal in accordance with the first detection result signal; and the gamma voltage module is electrically connected to the control module to receive the first control signal output from the control module, and generate a gamma reference voltage in accordance with the first control signal, wherein the gamma reference voltage is corresponding to a first gray scale voltage, the first gray scale voltage makes the adjusted display luminance of the red sub-pixel unit is greater than the initial display luminance of the red sub-pixel unit, the adjusted display luminance of the green sub-pixel unit is greater than the initial display luminance of the green sub-pixel unit, the adjusted display luminance of the blue sub-pixel unit is less than the initial display luminance of the blue sub-pixel unit within the pixel unit loading with the first gray scale voltage.

Wherein the gamma voltage module further including a gamma data storage unit, a gamma voltage generating unit and a voltage dividing unit; the gamma data storage unit is electrically connected to the control module, the gamma data storage unit stores the address information of a first binding point voltage, the gamma data storage unit is for receiving the first control signal output from the control module, finding the address information of the first binding point voltage in accordance with the first control signal, and generate a first address signal to indicate the address information of the first binding point voltage and output the first address signal; and the gamma voltage generating unit is electrically connected to the gamma data storage unit for receiving the first address signal output from the gamma data storage unit, and generating the first binding point voltage in accordance with the first indication signal; the voltage dividing unit is electrically connected to the gamma voltage generating unit for dividing the voltage of the first binding point voltage generated by the gamma voltage generating unit and to generate the first gamma reference voltage.

Wherein the gamma data storage unit has a Look-Up-Table, LUT information specific stores the first binding point voltage.

Wherein the image detection module is further used in detection the image input signal, when determining the gray scale indicated by the image input signal further including a non-pure color gray scale, to generate and output a second detection result signal to indicate the non-pure color gray scale; the control module is further configured to receive the second detection result signal output from the image detection module, and generate and output a second control signal in accordance with the second detection result signal; and the Gamma voltage module is further configured to receive the second control signal output by the control module, and generate a second gamma reference voltage according to the second control signal, the second gamma reference voltage is corresponding to the second gray scale voltage, the second gray scale voltage makes the adjusted display luminance of each sub pixel unit in the pixel unit loaded with the second gray scale voltage are respectively equal to the initial display luminance of each sub pixel unit.

A driving apparatus, including: a display row buffer, a level converter, a digital to analog converter, a buffer amplifier and a gamma voltage generating circuit described above; the display row buffer is for acquiring an image input signal, converting the image input signal, to generate a parallel image data signal, and output the parallel image data signal; the level converter is electrically connected to the display row buffer for receiving the parallel image data signal output from the display row buffer and amplified and output the parallel image data signal; the digital to analog converter, the level converter and the gamma voltage generating circuit are electrically connected, the digital to analog converter is used for acquiring the parallel image data signal amplified by the level converter and a gamma reference voltage output from the gamma voltage generating circuit, generating a first gray scale voltage in accordance with the amplified parallel image data signal and the first gamma reference voltage, the first gray scale voltage makes the adjusted display luminance of the red sub-pixel unit is greater than the initial display luminance of the red sub-pixel unit, the adjusted display luminance of the green sub-pixel unit is greater than the initial display luminance of the green sub-pixel unit, the adjusted display luminance of the blue sub-pixel unit is less than the initial display luminance of the blue sub-pixel unit within the pixel unit loading with the first gray scale voltage; and the buffer amplifier is electrically connected to the digital to analog converter, the buffer amplifier is loaded with the first gray scale voltage output from the digital to analog converter, the buffer amplifier is processed the load amplification to the first gray scale voltage, and to generate and output an analog signal to drive the pixel unit of the liquid crystal panel.

Wherein the gamma voltage module further including a gamma data storage unit, a gamma voltage generating unit and a voltage dividing unit; the gamma data storage unit is electrically connected to the control module, the gamma data storage unit stores the address information of a first binding point voltage, the gamma data storage unit is for receiving the first control signal output from the control module, finding the address information of the first binding point voltage in accordance with the first control signal, and generate a first address signal to indicate the address information of the first binding point voltage and output the first address signal; and the gamma voltage generating unit is electrically connected to the gamma data storage unit for receiving the first address signal output from the gamma data storage unit, and generating the first binding point voltage in accordance with the first indication signal; the voltage dividing unit is electrically connected to the gamma voltage generating unit for dividing the voltage of the first binding point voltage generated by the gamma voltage generating unit and to generate the first gamma reference voltage.

Wherein the gamma data storage unit has a Look-Up-Table, LUT information specific stores the first binding point voltage.

Wherein the image detection module is further used in detection the image input signal, when determining the gray scale indicated by the image input signal further including a non-pure color gray scale, to generate and output a second detection result signal to indicate the non-pure color gray scale; wherein, the control module is further configured to receive the second detection result signal output from the image detection module, and generate and output a second control signal in accordance with the second detection result signal; and the Gamma voltage module is further configured to receive the second control signal output by the control module, and generate a second gamma reference voltage according to the second control signal, the second gamma reference voltage is corresponding to the second gray scale voltage, the second gray scale voltage makes the adjusted display luminance of each sub pixel unit in the pixel unit loaded with the second gray scale voltage are respectively equal to the initial display luminance of each sub pixel unit.

Therefore, the gamma voltage generating circuit and the driving apparatus of the present application, the image detection module in the gamma voltage generating circuit is for detecting the image input signal, when determining the gray scale indicated by the image input signal including a pure color gray scale, output a first detection result signal to the control module; the control module generates a first control signal in accordance with the first detection result signal, the first control signal is for controlling the gamma voltage module generates a first gamma reference voltage; and the first gray scale voltage corresponding to the first gamma reference voltage can raise the adjusted display luminance of the R, G sub pixel units with a higher contribution to the overall display luminance of the pixel units, and decreasing the adjusted display luminance of the B sub pixel units with a less contribution to the overall display luminance, thereby increase the overall display luminance of the RGBW liquid crystal panel.

BRIEF DESCRIPTION OF THE DRAWINGS

In order to more clearly illustrate the embodiments of the present application or prior art, the following figures will be described in the embodiments are briefly introduced. It is obvious that the drawings are merely some embodiments of the present application, those of ordinary skill in this field can obtain other figures according to these figures without paying the premise.

DETAILED DESCRIPTION OF PREFERRED EMBODIMENTS

Embodiments of the present application are described in detail with the technical matters, structural features, achieved objects, and effects with reference to the accompanying drawings as follows. It is clear that the described embodiments are part of embodiments of the present application, but not all embodiments. In accordance with the embodiments of the present application, all other embodiments to those of ordinary skill in the premise of no creative efforts obtained should be considered within the scope of protection of the present application.

Specifically, the terminologies in the embodiments of the present application are merely for describing the purpose of the certain embodiment, but not to limit the invention. Examples and the claims be implemented in the present application requires the use of the singular form of the book "an", "the" and "the" are intend to include most forms unless the context clearly dictates otherwise. It should also be understood that the terminology used herein that "and/or" means and includes any or all possible combinations of one or more of the associated listed items.

Figure 1:
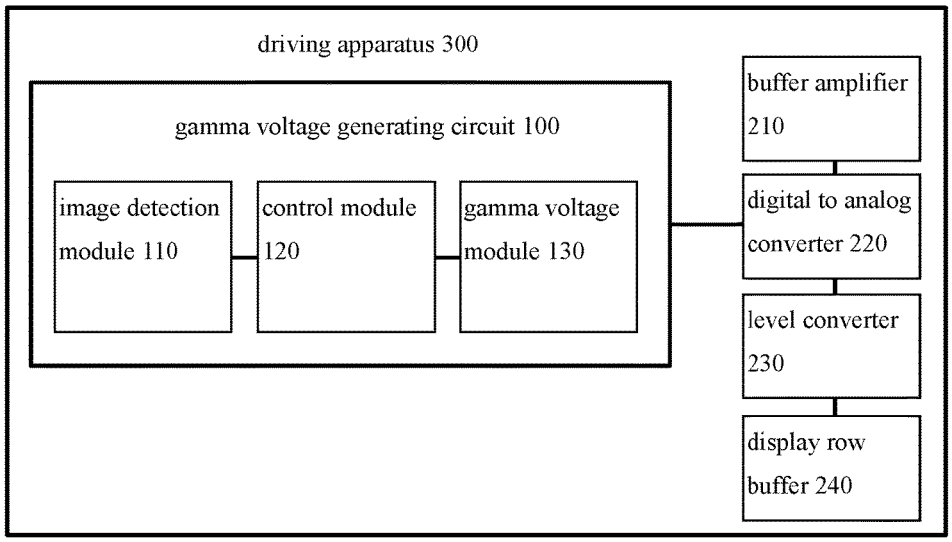
FIG. 1 is a schematic structure illustrating the driving apparatus of the present embodiment.

As illustrated in FIG. 1, the driving apparatus 300 of the first embodiment in the present application includes a display row buffer 240, a level converter 230, a digital to analog converter 220, a buffer amplifier 210 and a gamma voltage generating circuit 100. The driving apparatus 300 is capable of receiving an image input signal, by a series of processing to them, generating the gray-scale signal for driving the data line of the liquid crystal panel. In this embodiment, for simplicity, the embodiment is described with the driving apparatus 300 only including the circuit module mentioned above. It should be understood that, in fact, the driving apparatus 300 further includes other circuit modules with no more description here.

Wherein the display row buffer 240 is for acquiring an image input signal, converting the image input signal to generate a parallel image data signal, and output the parallel image data signal. The image input signal acquired by the display row buffer 240 is the RGB input signal, the RGB input signal is a serial signal, it need to be converted into the parallel image data signal to be transmitted and processed further.

The level converter 230 is electrically connected to the display row buffer 240 for receiving the parallel image data signal output from the display row buffer 240 and the parallel image data signal is amplified and output.

The gamma voltage generating circuit 100 is used for acquiring the image input signal, through a series of processing, and output of a gamma reference voltage in final.

The digital to analog converter 220, the level converter 230 and the gamma voltage generating circuit 100 are electrically connected. The digital to analog converter 220 is used for acquiring the parallel image data signal amplified by the level converter 230 and a set of the gamma reference voltage is output from the gamma voltage generating circuit 100, and then using the parallel image data signal amplified by the level converter 230 and selecting a gamma reference voltage from the set of the gamma reference voltage used for driving the data line of the liquid crystal panel. That is the digital to analog converter 220 includes a selector function, the gamma reference voltage selected from the digital to analog converter 220 is the gray scale voltage. The digital to analog converter 220 output the gray scale voltage to the buffer amplifier 210.

The buffer amplifier 210 is electrically connected to the digital to analog converter 220, the buffer amplifier 210 is loading the gray scale voltage output from the digital to analog converter 220. The buffer amplifier 210 is processed the load amplification to the gray scale voltage, to generate and output an analog signal to drive the data line of the liquid crystal panel.

Above is a general description of the driving apparatus 300 in the present embodiment. Hereinafter is described in detail of the gamma voltage generating circuit 100 in the present embodiment.

As illustrated in FIG. 1, the gamma voltage generating circuit 100 includes an image detection module 110, a control module 120 and a gamma voltage module 130.

Wherein, the image detection module 110 is for acquiring an image input signal, and detecting the image input signal, when determining the gray scale indicated by the image input signal including a pure color gray scale, to generate and output a first detection result signal for indicating the pure color gray scale.

Specifically, the image detection module 110 acquires the image input signal (ie, the RGB input signal), the RGB input signal carries gray scale for being displayed in a plurality of pixel units. Wherein the RGB input signals can include the pure color gray scale displaying pure color in some pixel units, it can also include the non-pure color gray scale displaying non-pure color in other pixel units. The pure color gray scale refers to one pixel unit, the one or two gray scale value of the R, G, B three sub-pixel units are zero, and the remaining is non-zero. For example, R=0, G=12, B=13, or R=0, G=0, B=13, etc. are pure color gray scale, the corresponding display state is the pure color display. The non-pure color gray scale refers to a pixel unit having a gray scale value except the gray scale value of the pure color gray scale, i.e., the gray scale value of the R, G, B three sub-pixel units are non-zero, for example, R=11, G=12, B=13, or R=13, G=13, B=13, etc; or gray scale values of the R, G, B three sub-pixel units are zero, the display state corresponding to the two cases are the non-pure color display. After acquiring the RGB input signal, the image detection module 110 is detecting the RGB input signal to determine the carried gray scale of the RGB input signal including the pure color gray scale or not. When confirming the pure color gray scale is included, the image detection module 110 generates a first detection result signal to indicate the pure color gray scale, and output the first detection result signal to the control module 120.

Wherein, the control module 120 is electrically connected to the image detection module 110, for receiving the first detection result signal output from the image detection module 110 and generating and outputting a first control signal in accordance with the first detection result signal. Specifically, the control module 120 receives the first detection result signal, and then in accordance with the pure color gray scale carried by the first detection result signal to generate and output the first control signal, the first control signal is used to control the gamma voltage module 130 to generate a gamma reference voltage.

Wherein the gamma voltage module 130 is electrically connected to the control module 120 to receive the first control signal output from the control module 120, and generate a set of gamma reference voltage in accordance with the first control signal, wherein the set of the gamma reference voltage includes a first gamma reference voltage. The first gamma reference voltage is corresponding to the first gray scale voltage, the first gray scale voltage makes the adjusted display luminance of the red sub-pixel unit is greater than the initial display luminance of the red sub-pixel unit, the adjusted display luminance of the green sub-pixel unit is greater than the initial display luminance of the green sub-pixel unit, the adjusted display luminance of the blue sub-pixel unit is less than the initial display luminance of the blue sub-pixel unit within the pixel unit loading with the first gray scale voltage.

Specifically, after the gamma voltage module 130 receives the first control signal, a set of the gamma reference voltage is generated in accordance with the first control signal, the set of the gamma reference voltage includes the first gamma reference voltage, the first gamma reference voltage is for driving the pixel unit to pure color display. The one set of the gamma reference voltage is output to the digital to analog converter 220, the digital to analog converter 220 receives the amplified parallel image input signal in the same time. The digital to analog converter 220 used the amplified parallel image input signal, and select the first gamma reference voltage from the set of the gamma reference voltage as the first gray level voltage (i.e., the first gamma reference voltage corresponding to the first gray scale voltage). Thereafter, the digital to analog converter 220 outputs the first gray scale voltage to drive the pixel unit for pure color display.

The selected first gamma reference voltage has a characteristic: the adjusted display luminance of the red sub-pixel unit is greater than the initial display luminance of the red sub-pixel unit, the adjusted display luminance of the green sub-pixel unit is greater than the initial display luminance of the green sub-pixel unit, the adjusted display luminance of the blue sub-pixel unit is less than the initial display luminance of the blue sub-pixel unit within the pixel unit loading with the first gray scale voltage.

Figure 2:
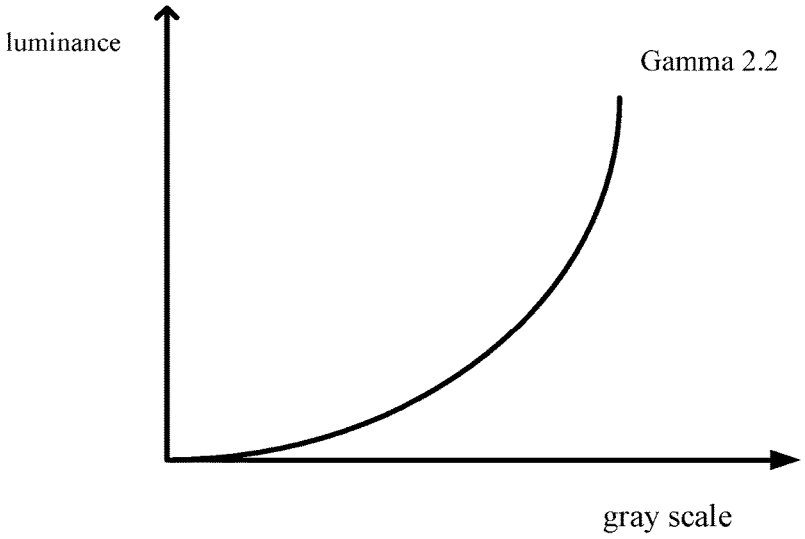
FIG. 2 is a schematic structure illustrating the gamma voltage module illustrated in FIG. 1.

As illustrated in FIG. 2, in the conventional technology, the relationship between the gray scale value of the sub-pixel and its display luminance meets the Gamma 2.2 curve. The R Gamma 2.2 curve, the G Gamma 2.2 curve and the B Gamma 2.2 curve are exits in FIG. 2 respectively, and the three Gamma curves are coincident. In this embodiment, the initial display luminance of each of the sub-pixel unit refers to proceed the pure color display, the display luminance of each sub-pixel unit corresponding to a specific gray scale of the Gamma 2.2 curve in the conventional technology. The adjusted display luminance of each of the sub-pixel unit refer to the display luminance to proceed the pure color display of each of the sub-pixel unit in accordance with the use of the present embodiment.

Figure 3:
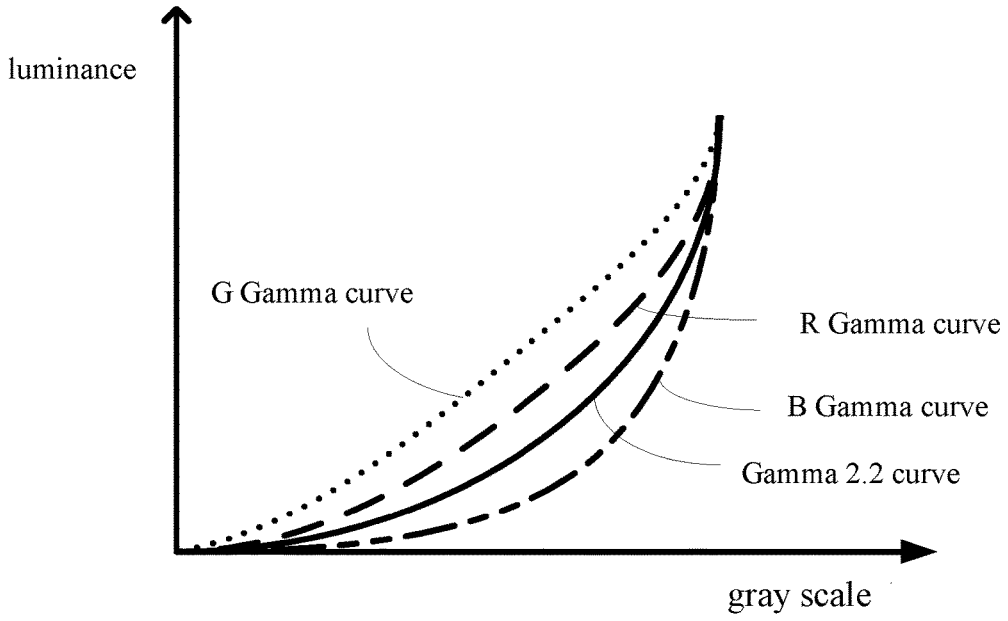
FIG. 3 is the Gamma 2.2 curve in the conventional technology.

As illustrated in FIG. 3, in this embodiment, the relationship between the adjusted display luminance and the gray scale of each of the sub-pixel unit still meets the gamma curve. However, this gamma curves is an adjusted gamma curve, and is different with the Gamma 2.2 curve mentioned above. Specifically illustrated in FIG. 3, in this embodiment, the rest portion except the two ends, the adjusted R gamma curve is above the R Gamma 2.2 curve, i.e. the adjusted display luminance of the red sub-pixel unit is greater than the initial display luminance of the red sub-pixel unit. It should be noted, according to conventional theory, the two ends of the adjusted R gamma curve is still coincide with the two ends of the R Gamma 2.2 curve. Similarly, illustrated in FIG. 3, the rest portion except the two ends, the adjusted G gamma curve is above the G Gamma 2.2 curve, i.e. the adjusted display luminance of the green sub-pixel unit is greater than the initial display luminance of the green sub-pixel unit; the rest portion except the two ends, the adjusted B gamma curve is below the B Gamma 2.2 curve, i.e. the adjusted display luminance of the blue sub-pixel unit is less than the initial display luminance of the blue sub-pixel unit.

The overall display luminance of the pixel units is decided by the display luminance of the R, G, B sub pixel units. Wherein the contribution of the R sub-pixel units to the overall display luminance is approximately 26%, the contribution of the G sub-pixel units to the overall display luminance is approximately 58%, and the contribution of the B sub-pixel units to the overall display luminance is approximately 16%. The method of the present embodiment, by making the adjusted display luminance of the R, G sub-pixel units are greater than the initial display luminance of the R, G sub-pixel units, the adjusted display luminance of the B sub-pixel unit is less than the initial display luminance of the B sub-pixel unit. That is, making the adjusted display luminance of the R, G, B sub pixel units meets the adjusted gamma curve of the R, G, B sub pixel units, thereby raising the display luminance of the R, G sub pixel units with a higher contribution to the overall display luminance, and decreasing the display luminance of the B sub pixel units with a less contribution to the overall display luminance. That is, the overall display luminance between the R, G, B three sub pixel units were reassigned.

Figure 4:
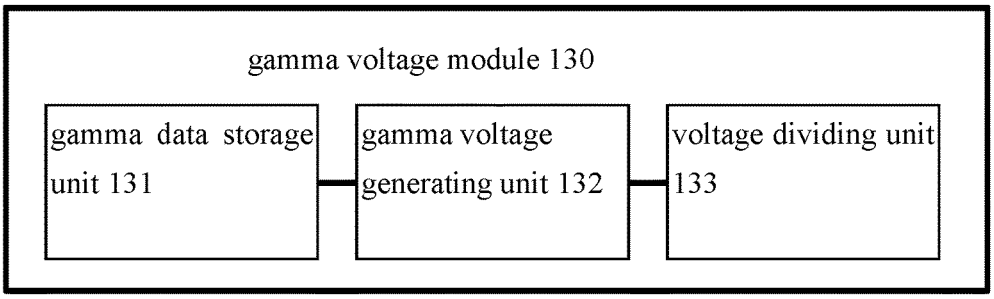
FIG. 4 is the adjusted Gamma curve provided in the embodiment of the present application.

Further, in the present embodiment, as illustrated in FIG. 4, the gamma voltage module 130 further includes a gamma data storage unit 131, a gamma voltage generating unit 132 and a voltage dividing unit 133.

Wherein the gamma data storage unit 131 is electrically connected to the control module 120, the gamma data storage unit 131 stores the address information of a first binding point voltage. The gamma data storage unit 131 is for receiving the first control signal output from the control module 120, finding the address information of the first binding point voltage in accordance with the first control signal, and generate a first address signal to indicate the address information of the first binding point voltage and output the first address signal. The first binding point voltage is also a gamma reference voltage for generating the first gamma reference voltage. In the present embodiment, preferred, the gamma data storage unit 131 has a Look-Up-Table, LUT information specific stores the first binding point voltage. In other embodiments, the gamma data storage unit 131 can also store the address information of the first binding point voltage in other ways.

The gamma voltage generating unit 132 is electrically connected to the gamma data storage unit 131 for receiving the first address signal output from the gamma data storage unit 131, and generating the first binding point voltage in accordance with the first indication signal.

The voltage dividing unit 133 is electrically connected to the gamma voltage generating unit 132 for dividing the voltage of the first binding point voltage generated by the gamma voltage generating unit 132 to generate the first gamma reference voltage.

Thus, the driving apparatus 300 of the present embodiment, by setting the gamma voltage generating circuit 100, the image detection module 110 of the gamma voltage generating circuit 100 can detect the image input signal, and after determining the gray scale indicated by the image input signal includes the pure color gray scale, output a first detection result signal to the control module 120; the control module 120 generates a first control signal in accordance with the first detection result signal, the first control signal is for controlling the gamma voltage module 130 to generate the first gamma reference voltage; and the first gray scale voltage corresponding to the first gamma reference voltage can raise the adjusted display luminance of the R, G sub-pixel units with high contribution to the overall display luminance of the pixel units and decrease the adjusted display luminance of the B sub-pixel units with low contribution to the overall display luminance of the pixel units, therefore increase the overall luminance performance of the RGBW liquid crystal display panel, further, by decreasing the adjusted display luminance of the B sub-pixel units to achieve the eye protection function by low blue light, and makes the RGBW liquid crystal display panel have the function of eye protection by low blue light.

In the second embodiment of the present application, the difference with the first embodiment described above is the image detection module 110 is also used in, after determining the gray scale indicated by the image input signal further includes the non-pure color gray scale, generate and output a second detection result signal to indicate the non-pure color gray scale. Accordingly, the control module 120 is further configured to receive the second detection result signal output from the image detection module 110, and generate and output a second control signal in accordance with the second detection result signal. The Gamma voltage module 130 is further configured to receive the second control signal output by the control module 120, and generate a second gamma reference voltage according to the second control signal. The second gamma reference voltage is corresponding to the second gray scale voltage, the second gray scale voltage makes the adjusted display luminance of each sub pixel unit in the pixel unit loaded with the second gray scale voltage are respectively equal to the initial display luminance of each sub pixel unit. Such as when the pixel unit performs the non-pure color display, the second gamma reference voltage generated by the gamma voltage generating circuit 100 in the present embodiment makes the display luminance of each sub pixel unit is decided according to Gamma 2.2 curve, without the distribution within each sub pixel unit of the overall display luminance.

Further, in the present embodiment, the gamma data storage unit 131 further stores an address information of a second binding point voltage. The gamma data storage unit 131 further configured to receive the second control signal output from the control module 120, finding the address information of the second binding point voltage in accordance with the second control signal, and generate a second address signal to indicate the address information of the second binding point voltage and output the second address signal. The second binding point voltage is also a gamma reference voltage for generating the second gamma reference voltage. In the present embodiment, preferred, the gamma data storage unit 131 has a Look-Up-Table, LUT information specific stores the second binding point voltage. In other embodiments, the gamma data storage unit 131 can also store the address information of the second binding point voltage in other ways. Accordingly, the gamma voltage generating unit 132 is further configured to receive the second address signal output from the gamma data storage unit 131 and generate the second binding point voltage according to the second address signal. The voltage dividing unit 133 is also used for dividing the voltage of the second binding point voltage generated by the gamma voltage generating unit 132 and to generate the second gamma reference voltage.

Above are embodiments of the present application, which does not limit the scope of the present application. Any modifications, equivalent replacements or improvements within the spirit and principles of the embodiment described above should be covered by the protected scope of the invention.

What is claimed is:

1. A gamma voltage generating circuit, comprising:

an image detection module, a control module and a gamma voltage module;

the image detection module is for acquiring an image input signal, and detecting the image input signal, when determining the gray scale indicated by the image input signal comprising a pure color gray scale, to generate and output a first detection result signal for indicating the pure color gray scale;

the control module is electrically connected to the image detection module, for receiving the first detection result signal output from the image detection module and generating and outputting a first control signal in accordance with the first detection result signal; and the gamma voltage module is electrically connected to the control module to receive the first control signal output from the control module, and generate a gamma reference voltage in accordance with the first control signal, wherein the gamma reference voltage is corresponding to a first gray scale voltage, the first gray scale voltage makes the adjusted display luminance of the red sub-pixel unit is greater than the initial display luminance of the red sub-pixel unit, the adjusted display luminance of the green sub-pixel unit is greater than the initial display luminance of the green sub-pixel unit, the adjusted display luminance of the blue sub-pixel unit is less than the initial display luminance of the blue sub-pixel unit within the pixel unit loading with the first gray scale voltage.

2. The gamma voltage generating circuit according to claim 1, wherein the gamma voltage module further comprising a gamma data storage unit, a gamma voltage generating unit and a voltage dividing unit;

the gamma data storage unit is electrically connected to the control module, the gamma data storage unit stores the address information of a first binding point voltage, the gamma data storage unit is for receiving the first control signal output from the control module, finding the address information of the first binding point voltage in accordance with the first control signal, and generate a first address signal to indicate the address information of the first binding point voltage and output the first address signal; and the gamma voltage generating unit is electrically connected to the gamma data storage unit for receiving the first address signal output from the gamma data storage unit, and generating the first binding point voltage in accordance with the first indication signal;

the voltage dividing unit is electrically connected to the gamma voltage generating unit for dividing the voltage of the first binding point voltage generated by the gamma voltage generating unit and to generate the first gamma reference voltage.

3. The gamma voltage generating circuit according to claim 2, wherein the gamma data storage unit has a Look-Up-Table, LUT information specific stores the first binding point voltage.

4. The gamma voltage generating circuit according to claim 1, wherein the image detection module is further used in detection the image input signal, when determining the gray scale indicated by the image input signal further comprising a non-pure color gray scale, to generate and output a second detection result signal to indicate the non-pure color gray scale;

wherein, the control module is further configured to receive the second detection result signal output from the image detection module, and generate and output a second control signal in accordance with the second detection result signal; and the Gamma voltage module is further configured to receive the second control signal output by the control module, and generate a second gamma reference voltage according to the second control signal, the second gamma reference voltage is corresponding to the second gray scale voltage, the second gray scale voltage makes the adjusted display luminance of each sub pixel unit in the pixel unit loaded with the second gray scale voltage are respectively equal to the initial display luminance of each sub pixel unit.

5. The gamma voltage generating circuit according to claim 4, wherein the gamma voltage module further comprising a gamma data storage unit, a gamma voltage generating unit and a voltage dividing unit;

the gamma data storage unit is electrically connected to the control module, the gamma data storage unit stores an address information of a second binding point voltage, the gamma data storage unit is configured to receive the second control signal output from the control module, finding the address information of the second binding point voltage in accordance with the second control signal, and generate a second address signal to indicate the address information of the second binding point voltage and output the second address signal;

the gamma voltage generating unit is electrically connected to the gamma data storage unit, and configured to receive the second address signal output from the gamma data storage unit and generate the second binding point voltage according to the second address signal;

the voltage dividing unit is electrically connected to the gamma voltage generating unit, and is used for dividing the voltage of the second binding point voltage generated by the gamma voltage generating unit and to generate the second gamma reference voltage.

6. A driving apparatus, comprising:

a display row buffer, a level converter, a digital to analog converter, a buffer amplifier and a gamma voltage generating circuit according to claim 1;

the display row buffer is for acquiring an image input signal, converting the image input signal, to generate a parallel image data signal, and output the parallel image data signal;

the level converter is electrically connected to the display row buffer for receiving the parallel image data signal output from the display row buffer and amplified and output the parallel image data signal;

the digital to analog converter, the level converter and the gamma voltage generating circuit are electrically connected, the digital to analog converter is used for acquiring the parallel image data signal amplified by the level converter and a gamma reference voltage output from the gamma voltage generating circuit, generating a first gray scale voltage in accordance with the amplified parallel image data signal and the first gamma reference voltage, the first gray scale voltage makes the adjusted display luminance of the red sub-pixel unit is greater than the initial display luminance of the red sub-pixel unit, the adjusted display luminance of the green sub-pixel unit is greater than the initial display luminance of the green sub-pixel unit, the adjusted display luminance of the blue sub-pixel unit is less than the initial display luminance of the blue sub-pixel unit within the pixel unit loading with the first gray scale voltage; and the buffer amplifier is electrically connected to the digital to analog converter, the buffer amplifier is loaded with the first gray scale voltage output from the digital to analog converter, the buffer amplifier is processed the load amplification to the first gray scale voltage, and to generate and output an analog signal to drive the pixel unit of the liquid crystal panel.

7. The driving apparatus according to claim 6, wherein the gamma voltage module further comprising a gamma data storage unit, a gamma voltage generating unit and a voltage dividing unit;

the gamma data storage unit is electrically connected to the control module, the gamma data storage unit stores the address information of a first binding point voltage, the gamma data storage unit is for receiving the first control signal output from the control module, finding the address information of the first binding point voltage in accordance with the first control signal, and generate a first address signal to indicate the address information of the first binding point voltage and output the first address signal; and the gamma voltage generating unit is electrically connected to the gamma data storage unit for receiving the first address signal output from the gamma data storage unit, and generating the first binding point voltage in accordance with the first indication signal;

the voltage dividing unit is electrically connected to the gamma voltage generating unit for dividing the voltage of the first binding point voltage generated by the gamma voltage generating unit and to generate the first gamma reference voltage.

8. The driving apparatus according to claim 7, wherein the gamma data storage unit has a Look-Up-Table, LUT information specific stores the first binding point voltage.

9. The driving apparatus according to claim 6, wherein the image detection module is further used in detection the image input signal, when determining the gray scale indicated by the image input signal further comprising a non-pure color gray scale, to generate and output a second detection result signal to indicate the non-pure color gray scale;

wherein, the control module is further configured to receive the second detection result signal output from the image detection module, and generate and output a second control signal in accordance with the second detection result signal; and the Gamma voltage module is further configured to receive the second control signal output by the control module, and generate a second gamma reference voltage according to the second control signal, the second gamma reference voltage is corresponding to the second gray scale voltage, the second gray scale voltage makes the adjusted display luminance of each sub pixel unit in the pixel unit loaded with the second gray scale voltage are respectively equal to the initial display luminance of each sub pixel unit.

10. The driving apparatus according to claim 9, wherein the gamma voltage module further comprising a gamma data storage unit, a gamma voltage generating unit and a voltage dividing unit;

the gamma data storage unit is electrically connected to the control module, the gamma data storage unit stores an address information of a second binding point voltage, the gamma data storage unit is configured to receive the second control signal output from the control module, finding the address information of the second binding point voltage in accordance with the second control signal, and generate a second address signal to indicate the address information of the second binding point voltage and output the second address signal;

the gamma voltage generating unit is electrically connected to the gamma data storage unit, and configured to receive the second address signal output from the gamma data storage unit and generate the second binding point voltage according to the second address signal;

the voltage dividing unit is electrically connected to the gamma voltage generating unit, and is used for dividing the voltage of the second binding point voltage generated by the gamma voltage generating unit and to generate the second gamma reference voltage.

* * * * *